US007222920B1

(12) United States Patent
Washington

(10) Patent No.: US 7,222,920 B1
(45) Date of Patent: May 29, 2007

(54) ADJUSTABLE CHAIR

(76) Inventor: James N. Washington, P.O. Box 534, Laurel, MD (US) 20745

( * ) Notice: Subject to any disclaimer, the term of this patent is extended or adjusted under 35 U.S.C. 154(b) by 52 days.

(21) Appl. No.: 11/154,505

(22) Filed: Jun. 17, 2005

(51) Int. Cl.
*A47C 3/00* (2006.01)
*A47C 3/026* (2006.01)

(52) U.S. Cl. ..... 297/383; 297/353

(58) Field of Classification Search ..... 297/383, 297/353
See application file for complete search history.

(56) References Cited

U.S. PATENT DOCUMENTS 2,400,630 A * 5/1946 Cramer et al. ..... 297/383 X
2,595,901 A * 5/1952 Sperring ..... 297/383 X
2,784,769 A * 3/1957 Fisher ..... 297/383 X
2,797,738 A 7/1957 Patterson
3,059,971 A * 10/1962 Becker ..... 297/353
3,720,443 A * 3/1973 Mourguer ..... 297/383
3,756,654 A * 9/1973 Bauer ..... 297/383 X
4,102,549 A * 7/1978 Morrison et al. ..... 297/383
D279,635 S 7/1985 Aasen
4,536,031 A * 8/1985 Latone ..... 297/383 X
5,035,466 A * 7/1991 Mathews et al. ..... 297/353 X
5,344,216 A 9/1994 Suominen
5,516,197 A 5/1996 Condos
5,542,743 A * 8/1996 Olson et al. ..... 297/353
5,775,776 A * 7/1998 Schooler et al. ..... 297/383 X
5,839,784 A * 11/1998 Breen ..... 297/383
5,902,013 A 5/1999 Hong
6,189,971 B1 2/2001 Witzig
6,199,945 B1 * 3/2001 Kim ..... 297/383 X
6,209,963 B1 * 4/2001 Gust et al. ..... 297/383 X
6,371,556 B1 * 4/2002 Arai ..... 297/383 X
6,394,547 B1 * 5/2002 Vik ..... 297/383 X
6,467,848 B1 * 10/2002 Gien et al. ..... 297/383 X
6,488,333 B2 * 12/2002 Kim ..... 297/383 X
6,494,531 B1 * 12/2002 Kim ..... 297/383 X
6,619,745 B2 * 9/2003 Roberts et al. ..... 297/383
6,659,560 B1 * 12/2003 Chi ..... 297/383
6,767,040 B1 * 7/2004 Freijy ..... 297/383 X
6,921,135 B2 * 7/2005 Ellis et al. ..... 297/353 X
7,125,076 B2 * 10/2006 Beranek et al. ..... 297/383 X

FOREIGN PATENT DOCUMENTS

DE 3714954 A1 * 11/1987 ..... 297/383
JP 58026643 A * 2/1983 ..... 297/383
JP 59018028 A * 1/1984 ..... 297/383

* cited by examiner

*Primary Examiner*—Rodney B. White

(57) ABSTRACT

A chair includes back and seat portions that include a padded member. Back support rails have opposed ends and include braces connected thereto. One end of the back support rails has notches that define flange portions. The braces traverse a rear surface of the back portion so that opposed ends thereof are conjoined to corresponding ones of the rail ends. A seat support member has a bottom surface and sidewalls extending upward therefrom that have notches formed along a top surface thereof. The seat support member includes inner lip portions. The flange portions are engageable with the inner lip portions, maintaining the back portion at a stable position. A shaft is conjoined to the seat support portion, legs are conjoined to the shaft, and casters are connected to the legs. A mechanism is included for adjusting the back portion forwardly above the seat support member.

15 Claims, 4 Drawing Sheets

ADJUSTABLE CHAIR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to chairs and, more particularly, to an adjustable chair adaptable to a size of a user's thighs.

2. Prior Art

Various types of backrests are known, including fixed backrests, inclined backrests for support of the lumbar region of the back, and height adjustable backrests. Also known are car seats and the like that are fitted with equipment to move the whole seat such as glide rails or the like. Certain office chairs are also known to be capable of adjusting their lumbar support region.

A conventional task chair has a standardized seat depth of approximately 40 to 43 cm. There is sufficient space on the seat surface for a person's buttocks and, depending on the size of the person sitting on the chair, a variable length of the thigh. For shorter persons, the front edge of the chair is often too far forward, so that the blood vessels in the legs are compressed by the front edge, thus hindering the blood supply to the legs. The unpleasant and unhealthy consequences are cold feet and varicose veins. To correct the seat depth, in some task chairs, the position of the backrest is adjustable; that is, the person sitting in the chair can choose how great the distance between the front edge of the chair and the backrest should be. However, if the seat surface is physiologically shaped, then a shorter person sits too far forward or a tall person sits too far to the rear on the seat surface.

A seat depth adjustment for motor vehicle seats is known in the prior art. In it, the seat region at the front of the seat is movable in the longitudinal direction of the vehicle. The front seat region is secured to the seat by two parallel retaining arms, which can be swiveled about a horizontal shaft fixed to the seat. Its top side is located partly under the seat surface. The retaining arms are articulated in the rear end of the moveable seat region, and an adjustable-length arm is pivotally secured to the seat at a rear shaft and articulated to the front end of the seat region. A disadvantage of this seat depth adjustment is that the retaining arms and the adjustable-length arm require shafts secured to the seat, which are disposed below and at a distance from the seat surface. Such a construction is unacceptable for task chairs for use in the office, because these arms under the seat surface are not only unattractive but do not guarantee enough space for the legs below the seat surface Accordingly, a need remains for an adjustable chair in order to overcome the above-noted shortcomings. The present invention satisfies such a need by providing an adjustable chair that is easy to use and adjust, durable in design, provides sufficient thigh support to people of various lengths, and improves productivity. Such an adjustable chair prevents the circulation to a person's legs from being cut off, thus preventing the formation of varicose veins. The adjustable chair can advantageously be used in a variety of business settings, as well as in commercial vehicles, such as trucks and busses.

BRIEF SUMMARY OF THE INVENTION

In view of the foregoing background, it is therefore an object of the present invention to provide an adjustable chair. These and other objects, features, and advantages of the invention are provided by an adjustable chair adaptable to a size of a user.

The chair includes back and seat portions. Such back and seat portions each include a padded member directly engageable with the user when the user sits on the chair. The rear surface of the back portion is substantially planar.

A plurality of oppositely spaced rectilinear back support rails have axially opposed end portions and include a plurality of coextensive braces directly connected thereto respectively. Such support rails preferably have substantially L-shapes. One end portion of the back support rails has a plurality of notches formed therein. Such notches define a plurality of flange portions equidistantly spaced from a centrally located longitudinal axis of the chair. The braces traverse a rear surface of the back portion in such a manner that opposed end portions of the braces are directly conjoined to corresponding ones of the end portions of the rails respectively.

A seat support member has a substantially planar bottom surface and a plurality of sidewalls extending vertically up therefrom such that the sidewalls travel parallel to the longitudinal axis. Such sidewalls have a plurality of juxtaposed and equidistantly spaced notches formed along a length of a top surface thereof respectively. The notches of the sidewalls may be coextensively shaped. Such notches travel forwardly from the back portion and terminate rearward of a front edge of the seat portion. The seat support member includes a plurality of monolithically formed inner lip portions extending along a length of the sidewalls respectively. The flange portions of the back support rails are slidably engageable with such inner lip portions of the seat support member such that the back portion can effectively be maintained at a substantially stable and vertically upright position during operating conditions.

A shaft is directly conjoined to the seat support member. Such a shaft extends orthogonally downward from the seat support member and is disposed generally medially of the seat portion for effectively maintaining the seat portion at an elevated position during operating conditions.

A plurality of legs are directly conjoined to the shaft. Such legs extend radially outwardly therefrom. A plurality of casters are directly connected subjacent to the legs.

A mechanism is included for independently adjusting a position of the back portion forwardly above the seat support member and along a horizontal plane. Such an independently adjusting mechanism preferably includes a rectilinear and elongated rod that has a centrally disposed longitudinal axis and axially opposed end portions. Each end portion of the rod includes a monolithically formed finger member extending downward therefrom. One of the rod end portions further includes a monolithically formed lever extending vertically therefrom.

Such a lever is pivotal along an arcuate path traveling ninety degrees between engaged and disengaged positions. The rod extends orthogonal to the longitudinal axis of the chair and spans across a width of the seat portion. The back portion is conveniently and selectively adjustable along a horizontal plane when the lever is pivoted to an engaged position such that the finger members are positioned within one of the notches of the sidewalls. The finger member is preferably positioned medially of the notches of the sidewalls when the lever is pivoted to an engaged position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
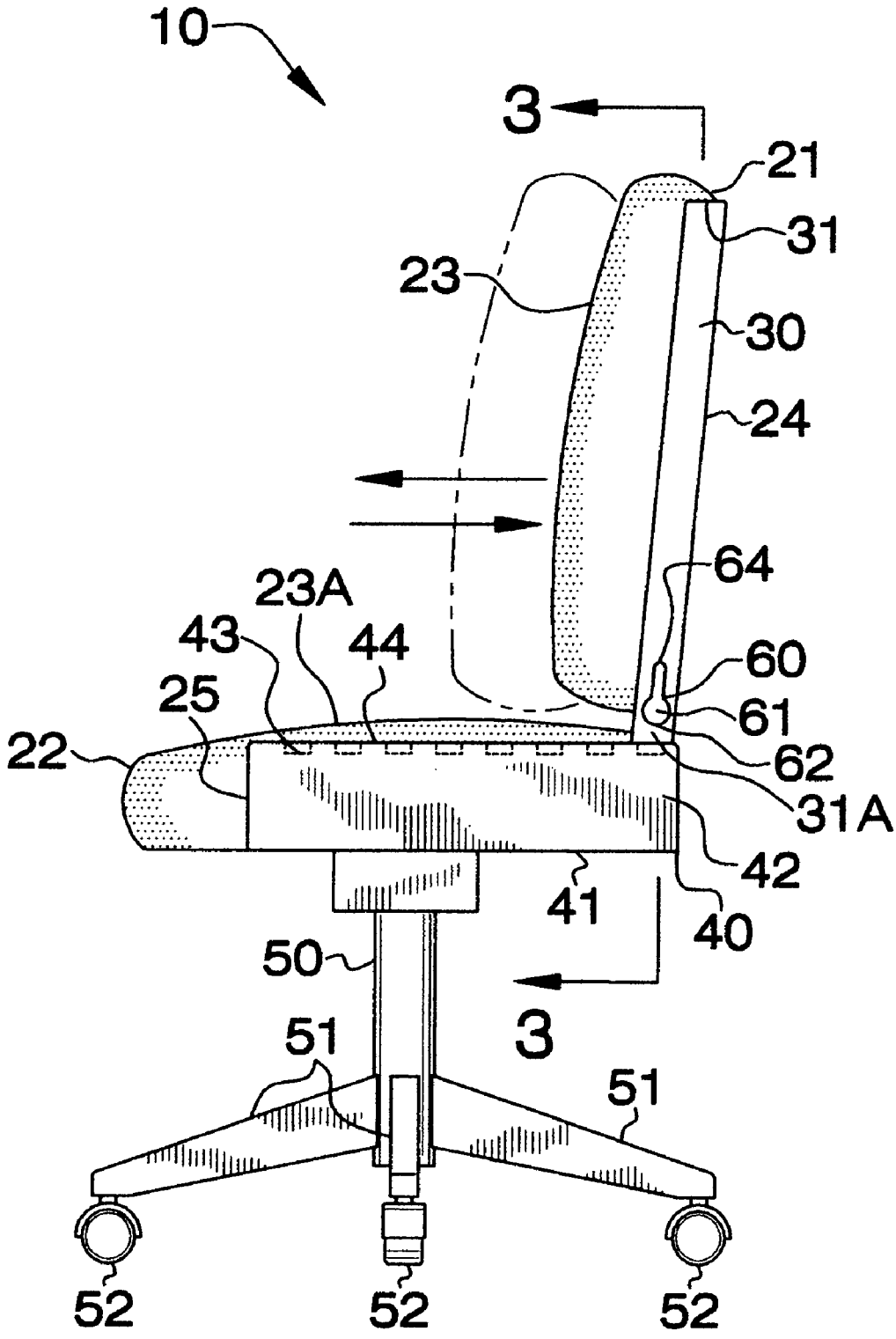
FIG. 1 is a side-elevational view showing an adjustable chair for optimizing the thigh support of a user, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide an adjustable chair. It should be understood that the apparatus 10 may be used to adjust the backrest of many different types of chairs and should not be limited in use to only office chairs.

Referring initially to FIG. 1, the apparatus 10 includes a back 21 and seat 22 portions. Such back 21 and seat 22 portions each include a padded member 23 directly engageable, with no intervening elements, with the user when the user sits on the chair, which is essential for providing comfortable support to the user's buttocks and back regions. Of course, the back 21 and seat 22 portions may include alternate support surfaces other than padded members 23, such as wicker or woven mesh material to name a few, as is obvious to a person of ordinary skill in the art. The rear surface 24 of the back portion 21 is substantially planar.

Figure 2:
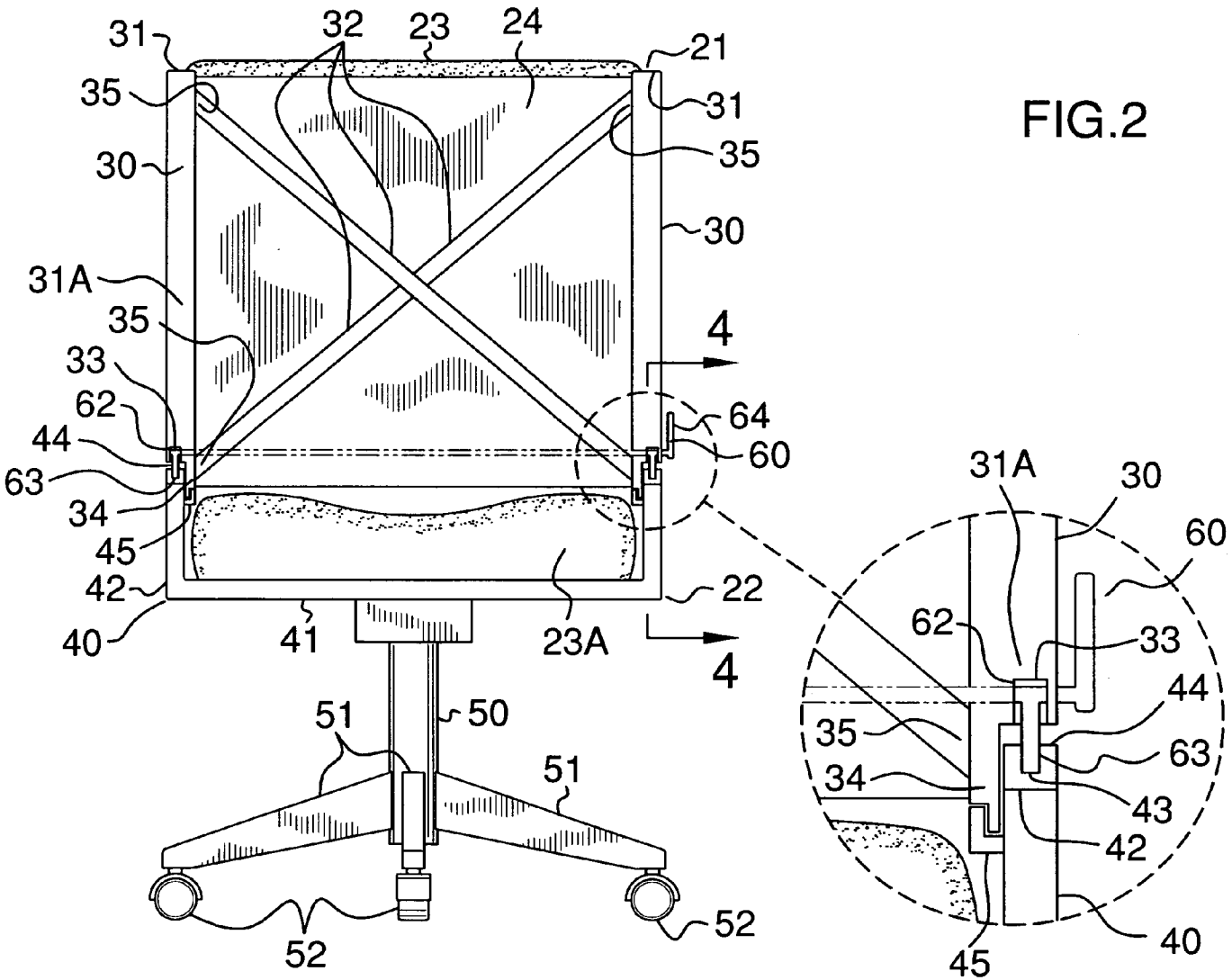
FIG. 2 is a rear-elevational view of the apparatus shown in 1.
Figure 3:
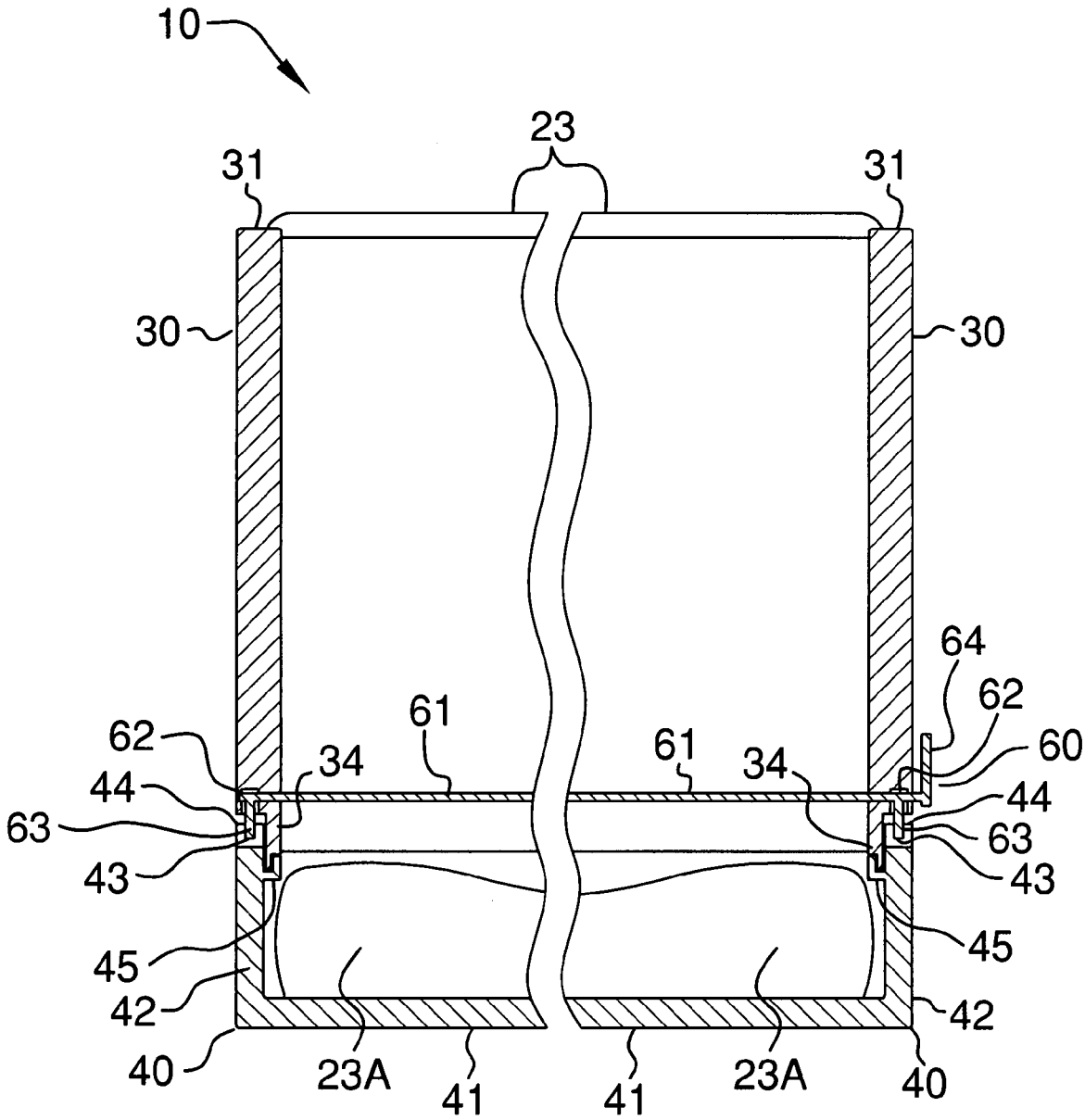
FIG. 3 is a cross-sectional view of the apparatus shown in FIG. 3, taken along line 3-3.

Referring to FIGS. 1 through 4, a plurality of oppositely spaced rectilinear back support rails 30 have axially opposed end portions 31 and include a plurality of coextensive braces 32 directly connected, with no intervening elements, thereto respectively, as is best shown in FIG. 2. Such support rails 30 have substantially L-shapes, which is important for maintaining the padded member 23 of the back portion 21 at a substantially stable position during operating conditions. Of course, the back support rails 30 may be alternately shaped, as is obvious to a person of ordinary skill in the art.

One end portion 31A of the back support rails 30 has a plurality of notches 33 formed therein. Such notches 33 define a plurality of flange portions 34 equidistantly spaced from a centrally located longitudinal axis of the chair 10. The braces 32 traverse a rear surface of the back portion 21 in such a manner that opposed end portions 35 of the braces 32 are directly conjoined, with no intervening elements, to corresponding ones of the end portions 31 of the rails 30 respectively. Such braces 32 effectively and advantageously support the padded member 23 of the back portion 21 at an upright and stable position.

Figure 4:
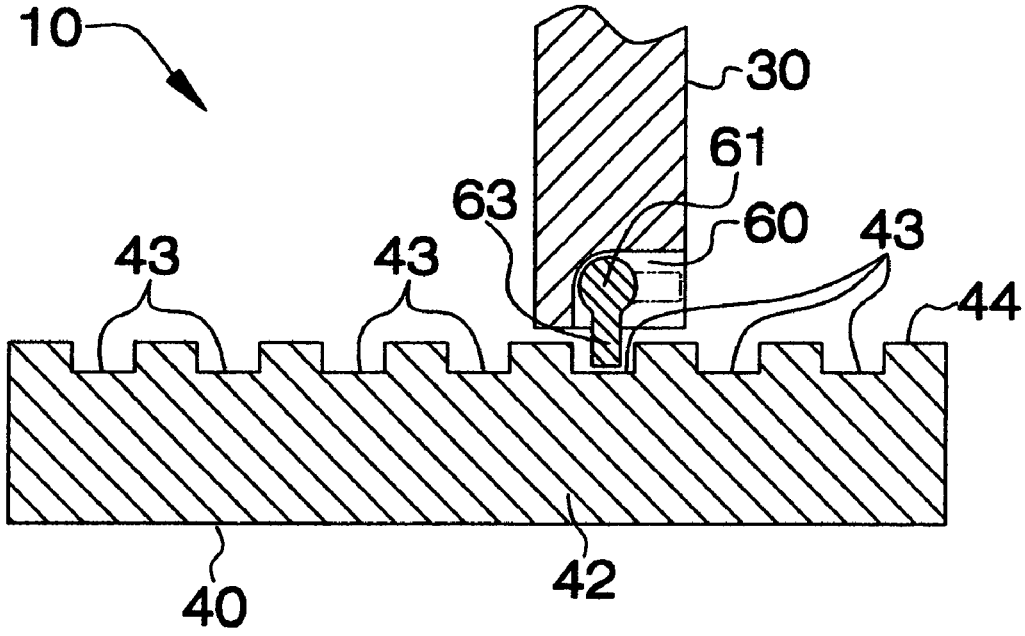
FIG. 4 is a cross-sectional view of the apparatus shown in FIG. 2, taken along line 4-4.

Still referring to FIGS. 1 through 4, a seat support member 40 has a substantially planar bottom surface 41 that is vital for supporting a padded member 23A thereon, and a plurality of sidewalls 42 extending vertically up therefrom such that the sidewalls 42 travel parallel to the longitudinal axis. Such sidewalls 42 have a plurality of juxtaposed and equidistantly spaced notches 43 formed along a length of a top surface 44 thereof respectively, as is best shown in FIG. 4.

The notches 43 of the sidewalls 42 are coextensively shaped, which is crucial for allowing the back portion 21 to remain straight prior to and after being adjusted to a desired setting. Such notches 43 travel forwardly from the back portion 21 and terminate rearward of a front edge 25 of the seat portion 22. Of course, the number and spacing of the notches 43 may be altered so as to change the number of possible positions the back portion 21 may assume, as is obvious to a person of ordinary skill in the art.

The seat support member 40 includes a plurality of monolithically formed inner lip portions 45 extending along a length of the sidewalls 42 respectively. The flange portions 34 of the back support rails 30 are slidably engageable with such inner lip portions 45 of the seat support member 40, which is crucial such that the back portion 21 can effectively be maintained at a substantially stable and vertically upright position during operating conditions.

Referring to FIGS. 1 and 2, a shaft 50 is directly conjoined, with no intervening elements, to the seat support member 40. Such a shaft 50 extends orthogonally downward from the seat support member 40 and is disposed generally medially of the seat portion 22, which is vital and convenient for effectively maintaining the seat portion 22 at an elevated position during operating conditions. Of course, the shaft 50 may be produced in a variety of alternate lengths or may be produced to be telescopically adjustable, as is obvious to a person of ordinary skill in the art. A plurality of legs 51 are directly conjoined, with no intervening elements, to the shaft 50 and extend radially outwardly therefrom. A plurality of casters 52 are directly connected, with no intervening elements, subjacent to the legs 51. Such casters 52 are critical and advantageous for allowing the apparatus 10 to be easily transported between remote locations.

Referring to FIGS. 1 through 4, a mechanism 60 is included for independently adjusting a position of the back portion 21 forwardly above the seat support member 40 and along a horizontal plane. This is a critical feature that allows individuals with upper leg regions of varying lengths to effectively and advantageously adjust the seat portion 22 of apparatus 10 to optimally support their thighs in the sitting position such that blood flow to their lower extremities is not impeded. Such an independently adjusting mechanism 60 includes a rectilinear and elongated rod 61 that has a centrally disposed longitudinal axis and axially opposed end portions 62. Each end portion 62 of the rod 61 includes a monolithically formed finger member 63 extending downward therefrom. One of the rod end portions 61A further includes a monolithically formed lever 64 extending vertically upward therefrom.

Still referring to FIGS. 1 through 4, such a lever 64 is pivotal along an arcuate path traveling ninety degrees between engaged and disengaged positions. The rod 61 extends orthogonal to the longitudinal axis of the chair 10 and spans across a width of the seat portion 22. The back portion 21 is conveniently and selectively adjustable along a horizontal plane when the lever 64 is pivoted to an engaged position such that the finger members 63 are positioned within one of the notches 43 of the sidewalls 42. The finger member 63 is positioned medially of the notches 43 of the sidewalls 42 when the lever 64 is pivoted to an engaged position, as is best shown in FIG. 4. Of course, the apparatus 10 may be provided with an automated seat adjusting mechanism including electric motors, serrated gears and serrated tracks, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An adjustable chair adaptable to a size of a user, said chair comprising:

back and seat portions, said back and seat portions each including a padded member directly engageable with the user when the user sits on said chair;

a plurality of oppositely spaced rectilinear back support rails having axially opposed end portions and including a plurality of braces directly connected thereto respectively, one said end portions of said back support rails having a plurality of notches formed therein, the notches defining a plurality of flange portions equidistantly spaced from a centrally located longitudinal axis of said chair, said braces traversing a rear surface of said back portion in such a manner that opposed end portions of said braces are directly conjoined to corresponding ones of said end portions of said rails respectively;

a seat support member having a substantially planar bottom surface and a plurality of sidewalls extending vertically up therefrom such that said sidewalls travel parallel to the longitudinal axis, said sidewalls having a plurality of juxtaposed and equidistantly spaced notches formed along a length of a top surface thereof respectively, the notches traveling forwardly from said back portion and terminating rearward of a front edge of said seat portion, said seat support member including a plurality of monolithically formed inner lip portions extending along a length of said sidewalls respectively, said flange portions of said back support rails being slidably engageable with said inner lip portions of said seat support member such that said back portion can be maintained at a substantially stable and vertically upright position during operating conditions;

a shaft directly conjoined to said seat support member, said shaft extending orthogonally downward from said seat support member and being disposed generally medially of said seat portion for maintaining said seat portion at an elevated position during operating conditions;

a plurality of legs directly conjoined to said shaft, said legs extending radially outwardly therefrom;

a plurality of casters directly connected subjacent said legs; and means for independently adjusting a position of said back portion forwardly above said seat support member and along a horizontal plane.

2. The chair of claim 1, wherein said independently adjusting means comprises:

a rectilinear and elongated rod having a centrally disposed longitudinal axis and axially opposed end portions, each said end portions of said rod including a monolithically formed finger member extending downward therefrom, one said end portions of said rod further including a monolithically formed lever extending vertically therefrom, said lever being pivotal along an arcuate path traveling ninety degrees between engaged and disengaged positions, said rod extending orthogonal to the longitudinal axis of said chair and spanning across a width of said seat portion;

wherein said back portion is selectively adjustable along a horizontal plane when said lever is pivoted to an engaged position such that said finger members are positioned within one of the notches of said sidewalls.

3. The chair of claim 1, wherein said support rails have a substantially L shape.

4. The chair of claim 1, wherein the notches of said sidewalls are coextensively shaped.

5. The chair of claim 1, wherein said finger member is positioned medially of the notches of said sidewalls when said lever is pivoted to an engaged position.

6. An adjustable chair adaptable to a size of a user, said chair comprising:

back and seat portions, said back and seat portions each including a padded member directly engageable with the user when the user sits on said chair;

a plurality of oppositely spaced rectilinear back support rails having axially opposed end portions and including a plurality of coextensive braces directly connected thereto respectively, one said end portions of said back support rails having a plurality of notches formed therein, the notches defining a plurality of flange portions equidistantly spaced from a centrally located longitudinal axis of said chair, said braces traversing a rear surface of said back portion in such a manner that opposed end portions of said braces are directly conjoined to corresponding ones of said end portions of said rails respectively;

a seat support member having a substantially planar bottom surface and a plurality of sidewalls extending vertically up therefrom such that said sidewalls travel parallel to the longitudinal axis, said sidewalls having a plurality of juxtaposed and equidistantly spaced notches formed along a length of a top surface thereof respectively, the notches traveling forwardly from said back portion and terminating rearward of a front edge of said seat portion, said seat support member including a plurality of monolithically formed inner lip portions extending along a length of said sidewalls respectively, said flange portions of said back support rails being slidably engageable with said inner lip portions of said seat support member such that said back portion can be maintained at a substantially stable and vertically upright position during operating conditions;

a shaft directly conjoined to said seat support member, said shaft extending orthogonally downward from said seat support member and being disposed generally medially of said seat portion for maintaining said seat portion at an elevated position during operating conditions;

a plurality of legs directly conjoined to said shaft, said legs extending radially outwardly therefrom;

a plurality of casters directly connected subjacent said legs; and means for independently adjusting a position of said back portion forwardly above said seat support member and along a horizontal plane.

7. The chair of claim 6, wherein said independently adjusting means comprises:

a rectilinear and elongated rod having a centrally disposed longitudinal axis and axially opposed end portions, each said end portions of said rod including a monolithically formed finger member extending downward therefrom, one said end portions of said rod further including a monolithically formed lever extending vertically therefrom, said lever being pivotal along an arcuate path traveling ninety degrees between engaged and disengaged positions, said rod extending orthogonal to the longitudinal axis of said chair and spanning across a width of said seat portion;

wherein said back portion is selectively adjustable along a horizontal plane when said lever is pivoted to an engaged position such that said finger members are positioned within one of the notches of said sidewalls.

8. The chair of claim 6, wherein said support rails have a substantially L shape.

9. The chair of claim 6, wherein the notches of said sidewalls are coextensively shaped.

10. The chair of claim 6, wherein said finger member is positioned medially of the notches of said sidewalls when said lever is pivoted to an engaged position.

11. An adjustable chair adaptable to a size of a user, said chair comprising:

back and seat portions, said back and seat portions each including a padded member directly engageable with the user when the user sits on said chair, said rear surface of said back portion being substantially planar;

a plurality of oppositely spaced rectilinear back support rails having axially opposed end portions and including a plurality of coextensive braces directly connected thereto respectively, one said end portions of said back support rails having a plurality of notches formed therein, the notches defining a plurality of flange portions equidistantly spaced from a centrally located longitudinal axis of said chair, said braces traversing a rear surface of said back portion in such a manner that opposed end portions of said braces are directly conjoined to corresponding ones of said end portions of said rails respectively;

a seat support member having a substantially planar bottom surface and a plurality of sidewalls extending vertically up therefrom such that said sidewalls travel parallel to the longitudinal axis, said sidewalls having a plurality of juxtaposed and equidistantly spaced notches formed along a length of a top surface thereof respectively, the notches traveling forwardly from said back portion and terminating rearward of a front edge of said seat portion, said seat support member including a plurality of monolithically formed inner lip portions extending along a length of said sidewalls respectively, said flange portions of said back support rails being slidably engageable with said inner lip portions of said seat support member such that said back portion can be maintained at a substantially stable and vertically upright position during operating conditions;

a shaft directly conjoined to said seat support member, said shaft extending orthogonally downward from said seat support member and being disposed generally medially of said seat portion for maintaining said seat portion at an elevated position during operating conditions;

a plurality of legs directly conjoined to said shaft, said legs extending radially outwardly therefrom;

a plurality of casters directly connected subjacent said legs; and means for independently adjusting a position of said back portion forwardly above said seat support member and along a horizontal plane.

12. The chair of claim 11, wherein said independently adjusting means comprises:

a rectilinear and elongated rod having a centrally disposed longitudinal axis and axially opposed end portions, each said end portions of said rod including a monolithically formed finger member extending downward therefrom, one said end portions of said rod further including a monolithically formed lever extending vertically therefrom, said lever being pivotal along an arcuate path traveling ninety degrees between engaged and disengaged positions, said rod extending orthogonal to the longitudinal axis of said chair and spanning across a width of said seat portion;

wherein said back portion is selectively adjustable along a horizontal plane when said lever is pivoted to an engaged position such that said finger members are positioned within one of the notches of said sidewalls.

13. The chair of claim 11, wherein said support rails have a substantially L shape.

14. The chair of claim 11, wherein the notches of said sidewalls are coextensively shaped.

15. The chair of claim 11, wherein said finger member is positioned medially of the notches of said sidewalls when said lever is pivoted to an engaged position.

* * * * *